United States Patent [19]

Goldberg

[11] 4,219,248

[45] Aug. 26, 1980

[54] PIECES OF FURNITURE HAVING SWIVEL MOUNTED SETTING UNITS

[76] Inventor: Adolphe Goldberg, 12, rue Mirabeau, 94300 Vincennes, France

[21] Appl. No.: 936,092

[22] Filed: Aug. 22, 1978

[30] Foreign Application Priority Data

Oct. 7, 1977 [FR] France ..... 77 30278

[51] Int. Cl.[2] ..... A47B 88/00; A47F 7/08

[52] U.S. Cl. ..... 312/324; 312/326; 312/327; 211/36; 108/142

[58] Field of Search ..... 312/327, 324, 125, 191, 312/242, 238, 326, 328, 206; 108/142; 211/36

[56] References Cited

U.S. PATENT DOCUMENTS

| | | | |
|---|---|---|---|
| 442,202 | 12/1890 | Ritchie | 312/329 |
| 589,463 | 9/1897 | Case | 312/326 |
| 836,106 | 11/1906 | Feldkircher | 312/324 |
| 1,603,127 | 10/1926 | Lombardo | 312/326 |
| 1,952,686 | 3/1934 | Sakier | 312/326 |
| 2,163,615 | 6/1939 | Marsh | 312/324 |
| 2,163,835 | 6/1939 | Forrer | 312/191 |
| 2,905,518 | 9/1959 | Doesken | 312/326 |
| 2,965,429 | 12/1960 | Stanger | 312/238 |
| 3,165,368 | 1/1965 | Hughes et al. | 312/324 |
| 3,868,157 | 2/1975 | Robinson | 312/125 |
| 4,124,262 | 11/1978 | Schill | 312/238 |

FOREIGN PATENT DOCUMENTS

| | | | |
|---|---|---|---|
| 230054 | 11/1963 | Austria | 312/326 |

*Primary Examiner*—Victor N. Sakran
*Attorney, Agent, or Firm*—Fleit & Jacobson

[57] ABSTRACT

A piece of furniture possibly provided with shelves and usable for the storage of various goods. This piece of furniture comprises at least one storage unit consisting of an upper tray and a lower tray both secured at right angles to a vertical support element, which forms either a part of the door or the door itself of the furniture frame; the storage unit being pivotally mounted on bottom and top wall portions of the frame, respectively, at location areas which are decentralized with respect to the axis of the frame; the trays having a peripheral edge so irregularly curved as to enable the furniture doors to be swung about the decentralized location areas without any shock between two adjacent storage pivoting units.

2 Claims, 6 Drawing Figures

FIG_1
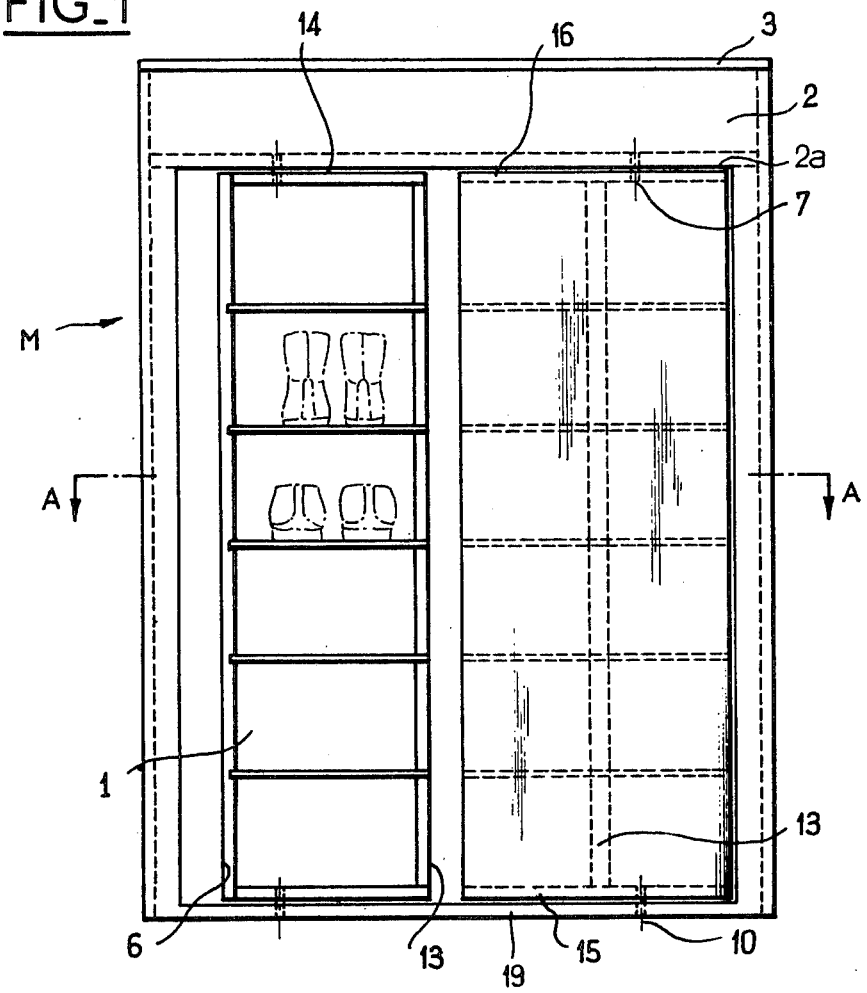
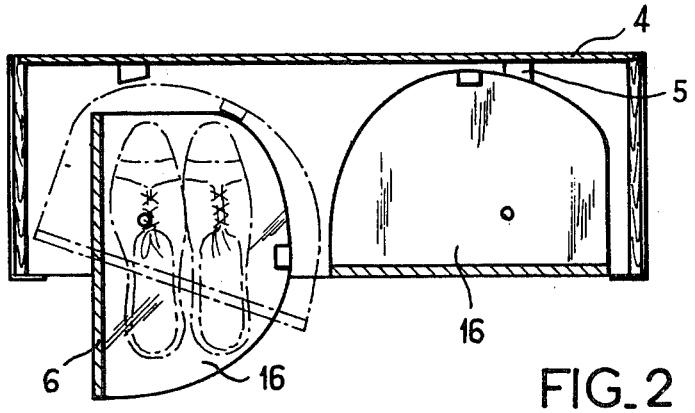
FIG_2

FIG. 3
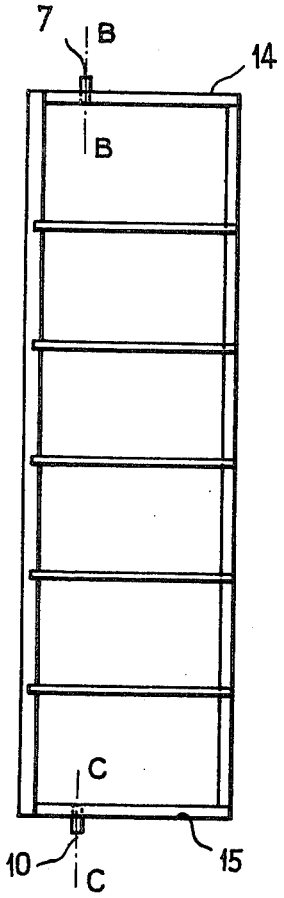
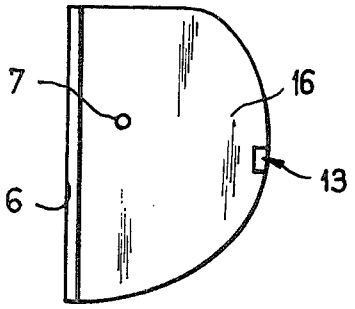
FIG. 4
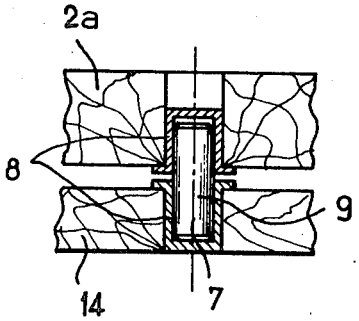
FIG. 5
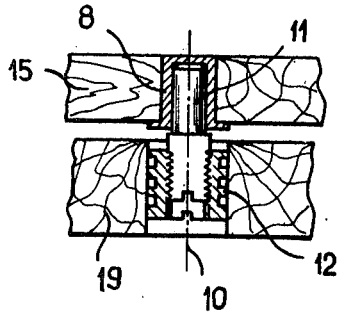
FIG. 6

PIECES OF FURNITURE HAVING SWIVEL MOUNTED SETTING UNITS

The invention relates to pieces of furniture or furniture units for storing various goods, such as shoes, pharmaceutical supplies, commonly used products and the like.

Pieces of furniture which are not very bulky are now available and intended to be used for the storage of shoes. Said pieces are accordingly provided with a rod system on which the shoes are stored on the bias, so as to enable the piece of furniture to be designed with a low transverse dimension. According to a peculiar disadvantage of such pieces of furniture, the shoes which are stored therein with the heels thereof bearing on the rods, slide and fall down as to form oddments, when the piece of furniture is subjected either to little displacements or to slight shocks. Other pieces of furniture have been designed with individual compartments.

Said pieces are bulky, due to the fact that the transverse size thereof is relatively large, for example from 33 to 35 cm. In addition to this disadvantage, the doors of said pieces must be opened inwards so as to have access to the shoes. Pieces of furniture which are provided with pivoting doors mounted axially in the piece housings are also known. Further, said doors which must be pivoted at 180° to not allow to reduce the overall dimensions of the relative pieces of furniture.

Accordingly, it is a general object of the invention to obviate the disadvantages of the prior pieces of furniture of this kind.

A further object of this invention is to provide a piece of furniture usable for the storage of various goods, said piece of furniture comprising at least one storage unit consisting of an upper tray and a lower tray, both secured at right angles to a vertical panel, which forms either a part of the door or the door itself of the furniture frame, said storage unit being pivotally mounted on bottom and top walls of said frame respectively at location areas which are decentralized with respect to the axis of said frame, said trays having a peripheral edge so irregularly curved as to enable the doors to be swung about the decentralized location areas thereof without any shock between two adjacent storage pivoting units.

The piece of furniture according to the invention is further characterized by the following features:

the lower tray is designed as a shelf;

the upper and lower trays as well as the shelves are connected together by a vertical rod which is substantially parallel to the vertical support element or door;

abutting means against which are abutting the edges of the trays and shelves are provided on the rear vertical portion of the furniture frame;

provision is made of first swivel means connecting said upper tray and said front wall portion and second adjustable swivel means connecting said lower tray and said bottom wall portion, said second swivel means being intended to adjust the level of the relative front vertical support element or door.

Further and lesser objects will become apparent from the following description and the accompanying drawings in which:

FIG. 1 is a front view showing the piece of furniture according to the invention;

FIG. 2 is a cross-sectional view according to line A—A of FIG. 1;

FIG. 3 is a side view of a pivoting unit according to the invention;

FIG. 4 is a top view of the pivoting unit shown in FIG. 3;

FIG. 5 is a detailed view of the top swivel means, along line B—B in FIG. 3; and FIG. 6 is a detailed view of the bottom swivel means, taken along line C—C in FIG. 3.

The storage piece of furniture consists of a frame M in which are mounted a plurality of pivoting units 1 (two of them are shown in the embodiment of FIG. 1). Each pivoting unit 1 comprises a vertical panel 6 on which are secured a plurality of shelves 16 having an irregularly curve-shaped peripheral edge. At right angle to the upper and lower ends of the vertical panel 6 are respectively provided trays 14, 15 having the same peripheral edge as shelves 16. Trays 14, 15 and shelves 16 are connected by a vertical rod 13 secured at the peripheral edge thereof, said rod being substantially parallel to the vertical panel 6.

On the upper face of tray 14 and on the lower face of tray 15 are respectively provided swivel means 7 and 10, which are mounted in locations decentralized with respect to the axis of the furniture frame. This arrangement enables the pivoting units 1, which also act as the doors, to pivot in the opening direction without involving any shock between the trays and shelves of two adjacent pivoting units. On the lower beam of the rear panel of the frame are provided abutting means 5 against which the edges of trays 14, 15 and shelves 16 come in abutment, when the doors or pivoting units 1 are closed. A certain clearance is provided between the opposite edges of sockets 8 as to enable the pivoting units to be adjusted.

The swivel axle of swivel means 7 is located within sockets 8 which are provided on the upper face of tray 14 and on the lower face of cross-member *2a*.

Swivel means 10 comprises a screw having an end so tapered as to form a pivot axle 11 located in a socket 8 which is inserted in the lower face of tray 15. Said screw 10 is located in an externally threaded socket 12 inserted in bottom cross-member 19 of frame M. Such an arrangement enables a double adjustment of the level of the pivoting units or furniture doors by actuating screw 10.

In the embodiment shown in FIG. 1, the piece of furniture M further comprises an upper compartment 2 provided with a cover plate 3, said compartment being usable for the storage of shoe brushes, shoe-polish tins and the like.

As shown in FIG. 1, the slight bulkiness due to the pivoting arrangement of the furniture doors enables an individual storage of each pair of shoes.

By way of comparison, a piece of furniture of the prior art has a depth of 35 cm; in addition to the width of the doors in the opening position, e.g. from 35 to 40 cm, the overall bulkiness amounts from 70 to 75 cm, whereas the piece of furniture of the invention has a bulkiness of 42 cm, the doors being in the opening position, the furniture depth amounting about 25 cm in addition of a bulking clearance of 17 cm, which is required for opening the doors.

Provision may also be made of a system of removable shelves as to adapt the furniture unit to the dimensions of the goods to be stored therein. Said shelves may be moulded from plastics materials and provided for instance with flanges and curved edges as to hinder any fall of the goods stored thereon.

According to a preferred embodiment, the irregularly curved peripheral edge of the trays and shelves consists of at least two arcs of different curve.

While in the foregoing description certain specific details of the present invention have been set forth, it is to be understood that modifications of the invention may be made by those skilled in the art without departing from the scope of the invention as defined in the following claims.

What I claim as new is:

1. A piece of furniture provided with at least one shelf for storage of goods, such as shoes, said piece of furniture comprising:

a furniture frame;

at least one storage unit comprising a vertical panel, a vertical member spaced from said panel and an upper tray and a lower tray both secured at right angles to said vertical panel and said vertical member, said vertical panel forming at least a part of a door of said furniture frame;

means for pivotally mounting said storage unit between bottom and top wall portions of said furniture frame, said mounting means including swivel means spaced from a vertically-extending axis passing through the center of the storage unit, said storage unit eccentrically pivoting about said swivel means;

said trays having irregularly curved peripheral edges formed from at least two arcs having different radii so that the portion of the door formed by the vertical panel moves without contacting said furniture frame during pivotal movement of said storage unit; and abutting means provided on a rear vertical portion of said furniture frame in such manner that a portion of at least one irregularly curved peripheral edge of one of said trays abuts there against to locate said vertical panel in a predetermined position.

2. A piece of furniture according to claim 1, comprising at least two storage units, said storage units being pivotally mounted in said furniture frame in such manner that the units are rotatable without contacting each other.

* * * * *